US010741974B2

(12) United States Patent
Miyamoto et al.

(10) Patent No.: US 10,741,974 B2
(45) Date of Patent: Aug. 11, 2020

(54) ELECTRICAL CONNECTOR

(71) Applicant: J.S.T. Mfg. Co., Ltd., Tokyo (JP)

(72) Inventors: Daichi Miyamoto, Miyoshi (JP); Yui Nagata, Miyoshi (JP)

(73) Assignee: J.S.T MFG. CO., LTD., Osaka-shi (JP)

( * ) Notice: Subject to any disclaimer, the term of this patent is extended or adjusted under 35 U.S.C. 154(b) by 0 days.

(21) Appl. No.: 16/275,102

(22) Filed: Feb. 13, 2019

(65) Prior Publication Data

US 2019/0252828 A1 Aug. 15, 2019

(30) Foreign Application Priority Data

Feb. 14, 2018 (JP) ..... 2018-023720

(51) Int. Cl.

| | |
|---|---|
| ***H01R 13/6583*** | (2011.01) |
| ***H01R 13/50*** | (2006.01) |
| ***H01R 24/50*** | (2011.01) |
| ***H01R 12/75*** | (2011.01) |
| ***H01R 12/71*** | (2011.01) |
| ***H01R 13/6582*** | (2011.01) |
| ***H01R 12/70*** | (2011.01) |

(52) U.S. Cl.

CPC ..... *H01R 13/6583* (2013.01); *H01R 13/50* (2013.01); *H01R 24/50* (2013.01); *H01R 12/7011* (2013.01); *H01R 12/716* (2013.01); *H01R 12/75* (2013.01); *H01R 13/6582* (2013.01)

(58) Field of Classification Search

CPC ..... H01R 13/6581–6583; H01R 13/50

See application file for complete search history.

(56) References Cited

U.S. PATENT DOCUMENTS

| | | | | | |
|---|---|---|---|---|---|
| 3,352,982 | A * | 11/1967 | Walther | H01R 13/6592 | 200/51.07 |
| 5,017,158 | A * | 5/1991 | Liu | H01R 13/506 | 439/607.23 |
| 5,035,652 | A * | 7/1991 | Shibano | H01R 13/506 | 439/108 |
| 5,222,909 | A * | 6/1993 | Nomura | H01R 13/6582 | 439/271 |
| 5,431,576 | A * | 7/1995 | Matthews | H01R 13/113 | 439/247 |
| 6,234,840 | B1 * | 5/2001 | Nakata | H01R 13/6593 | 439/607.01 |

(Continued)

FOREIGN PATENT DOCUMENTS

| | | |
|---|---|---|
| JP | 2010-282895 A | 12/2010 |
| JP | 5140837 B2 | 12/2010 |
| JP | 2014-60130 A | 4/2014 |

*Primary Examiner* — Oscar C Jimenez

(74) *Attorney, Agent, or Firm* — Kratz, Quintos & Hanson, LLP

(57) ABSTRACT

A housing holds a contact. A shield member is held in the housing and blocks electromagnetic waves. The shield member has a tubular shape, and the contact is arranged therein. The housing has an outer housing portion that is arranged outside of the shield member, and an inner housing portion that is arranged inside the shield member. The housing also has a joining portion that integrally joins the outer housing portion and the inner housing portion in an end portion on one side in a direction that is parallel to the direction of mating with the partner connector.

4 Claims, 9 Drawing Sheets

(56) References Cited

U.S. PATENT DOCUMENTS

| | | | | |
|---|---|---|---|---|
| 7,204,720 | B1 * | 4/2007 | Shiu | H01R 13/502 439/668 |
| 8,083,545 | B2 * | 12/2011 | Koitabashi | F04B 39/12 439/607.01 |
| 2003/0203658 | A1 * | 10/2003 | Zhao | H01R 24/50 439/63 |
| 2010/0040332 | A1 * | 2/2010 | Van Den Meersschaut | H01R 13/6582 385/75 |
| 2014/0053402 | A1 * | 2/2014 | Margrave | H01R 13/502 29/876 |
| 2016/0315425 | A1 * | 10/2016 | Nishimori | H01R 13/6583 |
| 2017/0018867 | A1 * | 1/2017 | Kimura | H01R 13/6471 |
| 2017/0244193 | A1 * | 8/2017 | Kondo | H01R 13/506 |
| 2018/0076579 | A1 * | 3/2018 | Tokita | H01R 24/38 |
| 2019/0237908 | A1 * | 8/2019 | Kojima | H01R 13/506 |

* cited by examiner

ELECTRICAL CONNECTOR

CROSS-REFERENCE TO RELATED APPLICATION

This application claims priority to Japanese Patent Application No. 2018-023720. The entire disclosure of Japanese Patent Application No. 2018-023720 is hereby incorporated herein by reference.

BACKGROUND OF THE INVENTION

1. Field of the Invention

The present invention relates to an electrical connector that has a metallic shield member for blocking electromagnetic waves.

2. Description of Related Art

Devices compatible with high frequency data transmission for the purpose of high-speed data processing have conventionally been used in various electronic devices for industrial use, household use, vehicular use, and the like. These electronic devices use shielded wires, printed circuit boards, and electrical connectors for connections therebetween. Particularly in the case of electronic devices for vehicles, there has been increasing demand in recent years for safe driving assistance technology and autonomous traveling technology, and the necessary amount of information has been increasing. This has been accompanied by an increase in demand on electrical connectors suited to high frequency data transmission. For example, JP 2014-60130A and JP 2010-282895A disclose electrical connectors that are for connecting a shielded wire to a printed circuit board and are compatible with high frequency data transmission.

JP 2014-60130A discloses an electrical connector that includes an inner terminal, an inner housing, an outer terminal, and an outer housing. The inner terminal is made of an electrically conductive metal material, and is configured to be capable of being electrically connected to a partner terminal. The inner housing is made of an insulating resin material, and holds the inner terminal therein. The outer terminal is shaped as a tube, and holds the inner terminal therein via the inner housing. The outer terminal is made of an electrically conductive metal material, and is provided in order to achieve a shielding function for preventing electromagnetic waves from reaching the contact that is housed inside. The outer housing is made of an insulating resin material, and holds the inner terminal, the inner housing, and the outer terminal therein.

Also, J P 2010-282895A discloses an electrical connector that includes a contact portion, a shield outer tube, and a socket main body. The contact portion is made of an electrically conductive metal material, and is configured to be capable of being electrically connected to a partner terminal. The shield outer tube is made of an electrically conductive metal material, is formed so as to cover the contact portion, and is provided in order to achieve a shielding function for preventing electromagnetic waves from reaching the contact that is housed inside. The shield outer tube is formed such that a pair of end side portions in the upper portion face each other, and has a slit-shaped gap. Also, the socket main body is made of an insulating resin material, has a portion that passes through the slit-shaped gap of the shield outer tube, and is formed such that a portion inside the shield outer tube and a portion outside the shield outer tube are integrally connected.

SUMMARY OF THE INVENTION

In the electrical connector disclosed in JP 2014-60130A, the outer terminal is tube-shaped, thus ensuring overall rigidity for the connector. However, this electrical connector is constituted by four components, namely the inner terminal, the outer terminal, the inner housing, and the outer housing, thus inviting an increase in the number of components. This increase in the number of components is accompanied by an increase in labor during manufacturing and assembly.

In the electrical connector disclosed in JP 2010-282895A, the socket main body is constituted by one component, and therefore the electrical connector is constituted by three components overall. However, due to the socket main body being constituted by one component, the slit-shaped gap is formed in the side wall of the shield outer tube. This electrical connector therefore has a problem of inviting a decrease in the rigidity of the connector. This electrical connector also has a problem of a decrease in shielding performance due to the fact that electromagnetic waves intrude through the slit-shaped gap.

In light of the above-described circumstances, an object of the present invention is to provide an electrical connector that makes it possible to reduce the number of components, improve rigidity, and also suppress a decrease in shielding performance.

(1) An electrical connector according to an aspect of the present invention for achieving the aforementioned object is an electrical connector for connection to a partner connector by mating, the electrical connector including; a contact; a housing configured to hold the contact; and a shield member configured to be held in the housing and block electromagnetic waves, wherein the shield member has a tubular shape, and the contact is arranged inside the shield member, and the housing has an outer housing portion arranged outside of the shield member, an inner housing portion arranged inside the shield member, and a joining portion that integrally joins the outer housing portion and the inner housing portion in an end portion on one side in a direction parallel to a direction of mating with the partner connector.

According to this configuration, in the electrical connector, the housing that holds the shield member has the joining portion that integrally joins the outer housing portion and the inner housing portion in an end portion on one side in the direction parallel to the direction of mating with the partner connector. In other words, the housing is constituted by one component in which the outer housing portion and the inner housing portion are integrated via the joining portion. Accordingly, it is possible to reduce the number of components that constitute the electrical connector.

Also, the joining portion is provided in the end portion on one side of the housing, and therefore the shield member held in the housing is not provided with a slit-shaped gap in a side wall, and has a tubular shape. This therefore improves the bending resistance and twisting resistance of the shield member, and improves the rigidity of the electrical connector.

Furthermore, due to the shield member having a tubular shape, and the contact being arranged therein, a gap that allows the intrusion of electromagnetic waves is not formed in the region surrounding the contact, and the contact is reliably shielded by the shield member. Accordingly, a decrease in the shielding performance of the electrical connector can be suppressed.

Accordingly, with the above configuration, it is possible to provide an electrical connector that enables reducing the number of components, improving rigidity, and suppressing a decrease in shielding performance. Also, due to reliably blocking the intrusion of electromagnetic waves toward the contact, the electrical connector having the above configuration reliably exhibits shielding performance, and therefore is suitable for high frequency data transmission.

(2) A configuration is possible in which the joining portion is provided in an end portion of the housing on a side that is to be connected to the partner connector by mating.

According to this configuration, in the electrical connector, the joining portion is provided in the end portion of the housing on the side that is connected to the partner connector by mating. For this reason, the direction in which the shield member is attached to the housing during assembly of the electrical connector can be set opposite to the direction in which a partner shield member is connected to the housing by mating. Accordingly, it is possible to avoid the case where the end portion of the shield member and the end portion for connection to the partner connector by mating are both arranged in the end portion on one side in the direction parallel to the mating direction. In other words, only the joining portion is arranged in the end portion on the one side in the direction parallel to the direction of mating with the partner connector, and the shield member is arranged in the end portion on the opposite side. Accordingly, it is possible to prevent the structure of the electrical connector from becoming complex, and the end portion of the joining portion on the side that is connected to the partner connector by mating has a simple structure, thus making it possible to obtain an electrical connector that can be connected easily.

(3) A configuration is possible in which the housing is provided such that an end portion of the housing that is to be connected to the partner connector by mating covers at least part of an end portion of the shield member.

According to this configuration, the housing is provided so as to cover part or all of the end portion of the shield member on the side that is mated with the partner connector. Moreover, the housing is made of an insulating resin material. For this reason, even if the end portion of the partner connector collides with the end portion of the electrical connector having the above configuration, it is possible to mitigate the impact, and it is possible to realize an electrical connector that is not likely to become damaged at the end portion. Also, the electrical connector having the above configuration may be realized as an electrical connector having a housing in which a portion that is in the end portion on the side that is connected to the partner connector by mating and that is inward of the outer circumferential edge portion covers at least part of the end portion of the shield member, for example.

(4) A configuration is possible in which the shield member has a rectangular tubular shape formed by four side walls, and three of the four side walls each have a contacting portion configured to come into contact with a partner shield member that blocks electromagnetic waves in the partner connector.

According to this configuration, in the electrical connector, the shield member has a rectangular tubular shape that is constituted by four side walls. Among the four side walls of the shield member, three side walls each have a contacting portion for coming into contact with the partner shield member that blocks electromagnetic waves in the partner connector. For this reason, the shield member can support the partner shield member from three directions when the connectors are connected. The shield member can therefore be grounded with the partner shield member in a stable state. The shield member is also in contact with the partner shield member at a larger number of locations, thus making it possible to realize more reliable grounding.

(5) A configuration is possible in which the shield member is configured to enable a partner shield member that blocks electromagnetic waves in the partner connector to be inserted into the shield member, and has a cantilevered elastic contacting portion configured to come into contact with the partner shield member.

In the case where the housing of the electrical connector is provided so as to cover the end portion of the shield member on the side for mating with the partner connector in order to prevent damage when a collision occurs between the connectors, it is desirable that the shield member is provided with a mechanism for connection to the inserted partner shield member. In the electrical connector having the above configuration, the shield member has an elastic contacting portion that undergoes outward elastic deformation when the partner shield member is inserted. The elastically deformed elastic contacting portion supports the partner connector by pressing a wall surface portion of the partner shield member when the connectors are connected. Accordingly, even in the case where the housing covers the end portion of the shield member so as to prevent damage when a collision occurs between the connectors, the shield member and the partner shield member can be connected by the elastic contacting portion when the connectors are connected. Moreover, when the connectors are connected, the contact is surrounded by two components, namely the shield member and the partner shield member that has been inserted into the shield member and is connected by the shield member. This therefore further improves the shielding performance.

Note that the above and other objects, features, and advantages of this invention will become apparent by reading the following description with the attached drawings.

DETAILED DESCRIPTION OF THE INVENTION

Hereinafter, embodiments for carrying out the present invention will be described with reference to the drawings. Note that the present invention can be broadly applied as an electrical connector in various applications, such as an electrical connector for high frequency data transmission.

Overview of Electrical Connector

Figure 1:
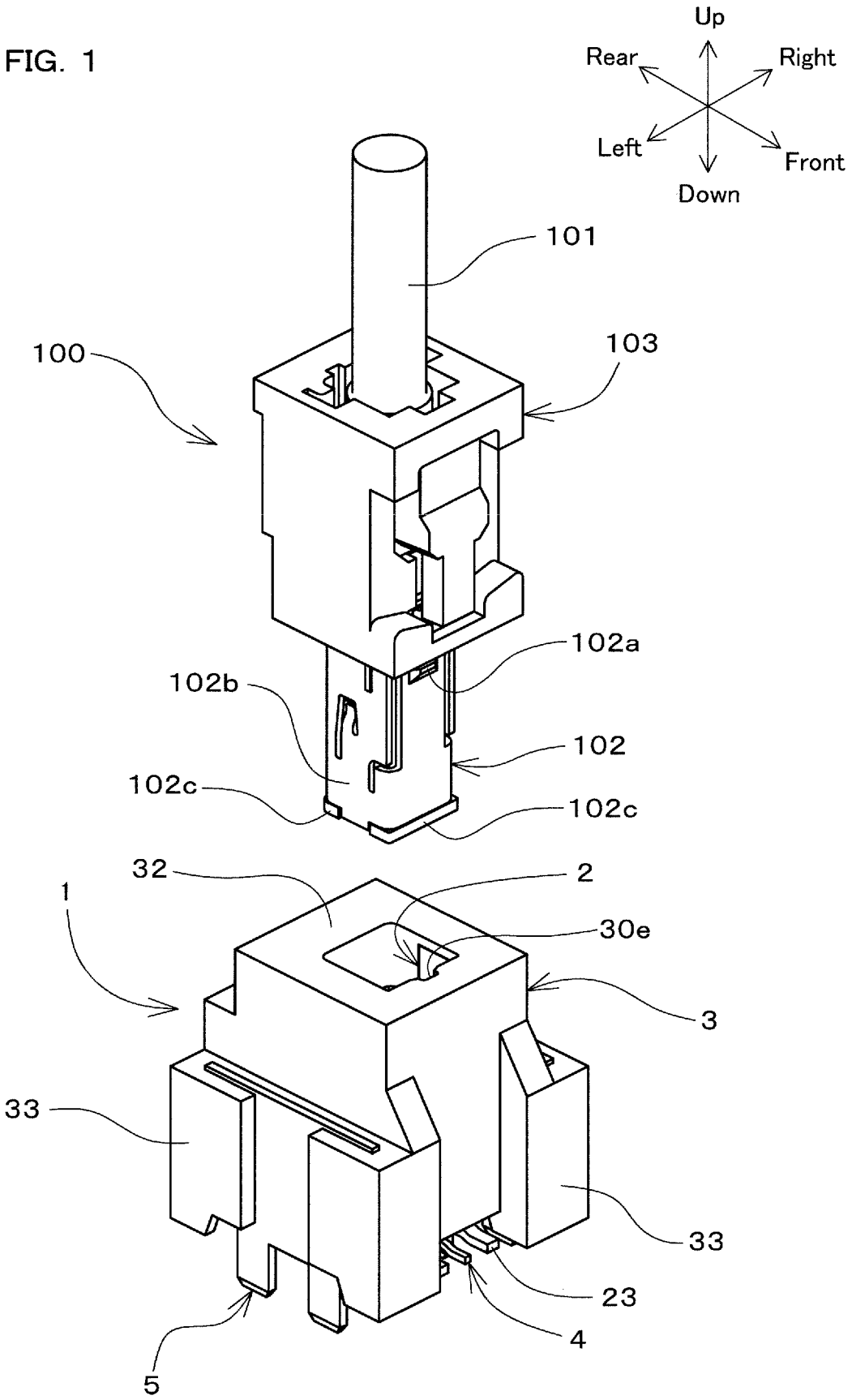
FIG. 1 is a perspective diagram showing an electrical connector according to an embodiment of the present invention, and also showing a partner connector for connection to the electrical connector.
Figure 2:
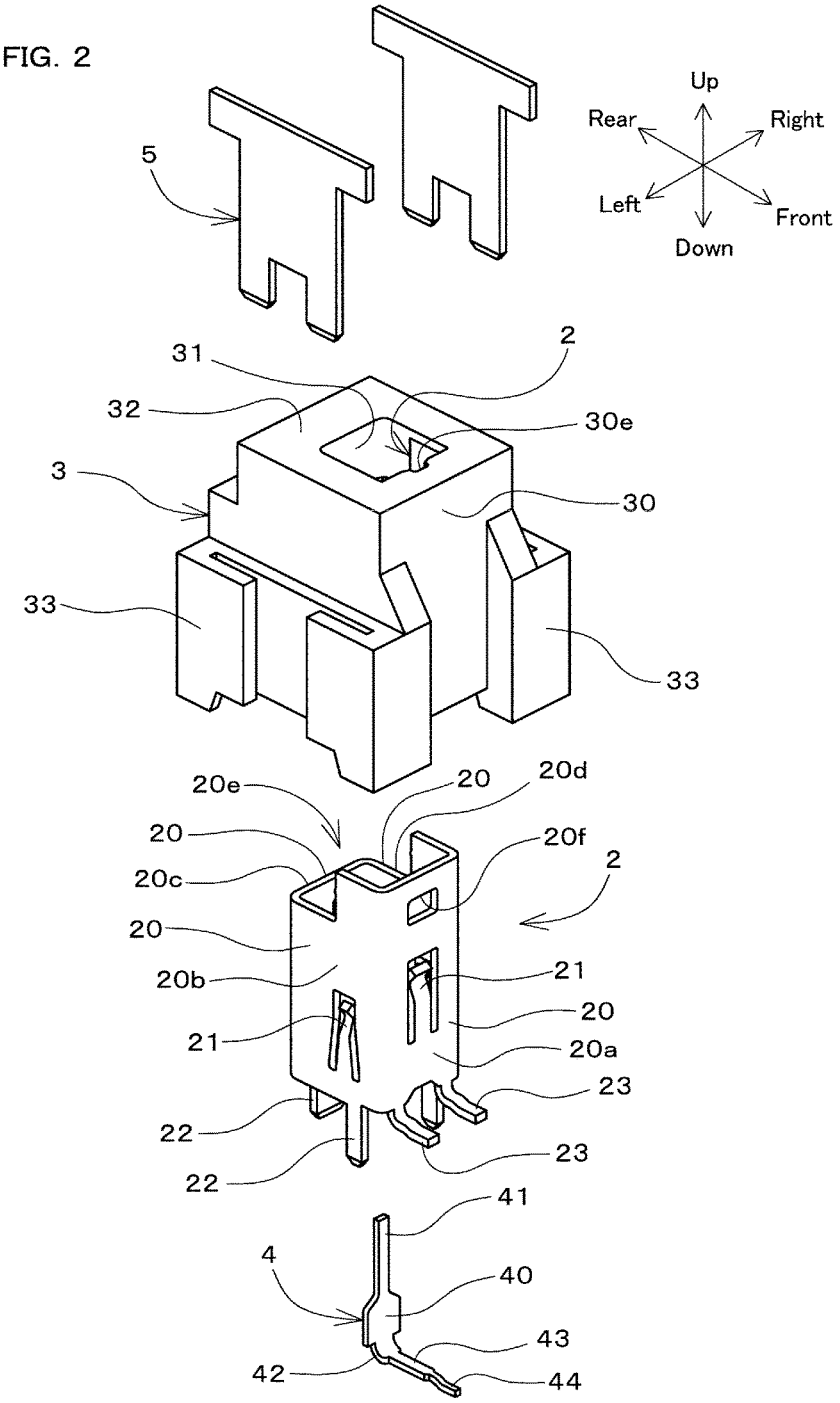
FIG. 2 is a perspective diagram showing an exploded state of the electrical connector shown in FIG. 1.

FIG. 1 is a perspective diagram showing an electrical connector 1 according to an embodiment of the present invention, and also showing a partner connector 100 for connection to the electrical connector 1. FIG. 1 shows a state before connection of the electrical connector 1 and the partner connector 100. FIG. 2 is a perspective diagram showing an exploded state of the electrical connector 1 shown in FIG. 1.

Note that in FIGS. 1 and 2, as well as the figures mentioned later, for convenience in the description, "rightward" refers to the direction indicated by the arrow denoted by "right", "leftward" refers to the direction indicated by the arrow denoted by "left", "upward" and "upper" refer to the direction indicated by the arrow denoted by "up", "downward" and "lower" refer to the direction indicated by the arrow denoted by "down", "forward" and "front" refer to the direction indicated by the arrow denoted by "front", and "rearward" and "rear" refer to the direction indicated by the arrow denoted by "rear". Also, "downward" refers to the direction in which the partner connector 100 is mated to the electrical connector 1 (mating direction), and "upward" refers to the direction in which the partner connector 100 is withdrawn from the electrical connector 1 (withdrawal direction). It should also be noted that the up-down direction in the electrical connector 1 is the height direction of the electrical connector 1, and the left-right direction in the electrical connector 1 is the width direction of the electrical connector 1.

The electrical connector 1 shown in FIG. 1 is a so-called top-type connector in which the lower side is connected to a substrate, and the upper side is connected to an electrical cable 101, which is constituted as a coaxial cable for example, via the partner connector 100. Note that the substrate is not depicted in the drawings. Also, in the following description, the state where the electrical connector 1 and the partner connector 100 are connected is referred to as "when the connectors are connected". The electrical connector 1 is electrically and mechanically connected to the substrate, and is detachably connected to the partner connector 100.

The electrical connector 1 is connected to the partner connector 100 by mating. The electrical connector 1 includes a contact 4, a housing 3 that holds the contact 4, and a shield member 2 that is held in the housing 3 and blocks electromagnetic waves. Also, the electrical connector 1 is fixed to the substrate via tabs 5 that are arranged on the right side and the left side of the housing 3.

The partner connector 100, which is connected to the electrical connector 1 by mating, has a partner shield member 102, a partner housing 103, and a partner contact. Note that the partner contact does not appear in the drawings. The partner shield member 102 is constituted as a conductive member that is made of a metal, and is provided in order to block electromagnetic waves arriving from the outside. The partner housing 103 is formed from an insulating resin material, and has the partner shield member 102 provided on one end side. The partner housing 103 is configured to receive connection of the electrical cable 101 on the other end side. The partner contact is provided inside the partner shield member 102, and is configured so as to be connected to the contact 4 of the electrical connector 1 by being mated thereto. The partner shield member 102 has an engaging protrusion portion 102*a* for engagement with the shield member 2, wall surface portions 102*b* for being pressed against and coming into contact with elastic contacting portions 21 provided in the shield member 2 when the connectors are connected, and protection portions 102*c* for protecting the leading end. Note that the protection portions 102*c* are made of an insulating resin material.

Shield Member

Figure 3A:
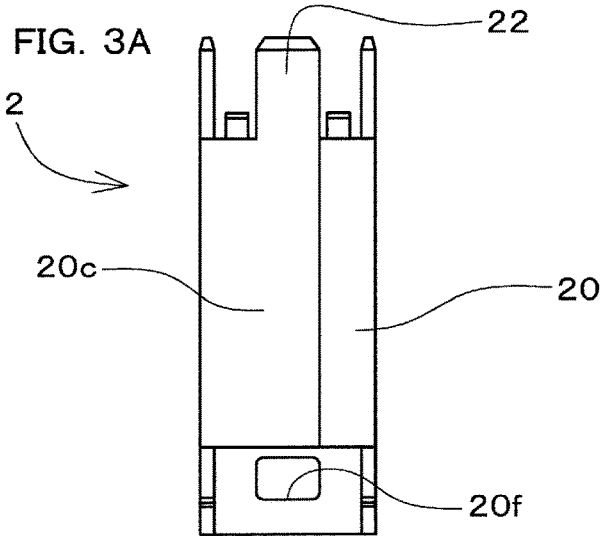
FIGS. 3A to 3D are diagrams showing a shield member of the electrical connector shown in FIG. 2, with FIG. 3A being a rear view, FIG. 3B being a left side surface, FIG. 3C being a plan view, and FIG. 3D being a front view.
Figure 3B:
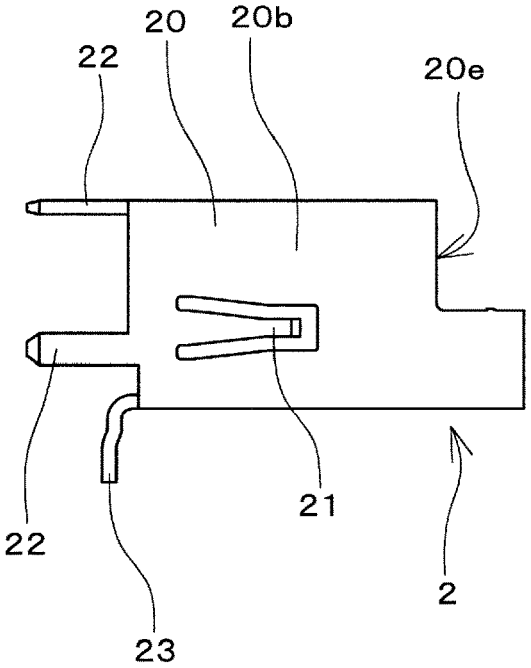
Figure 3C:
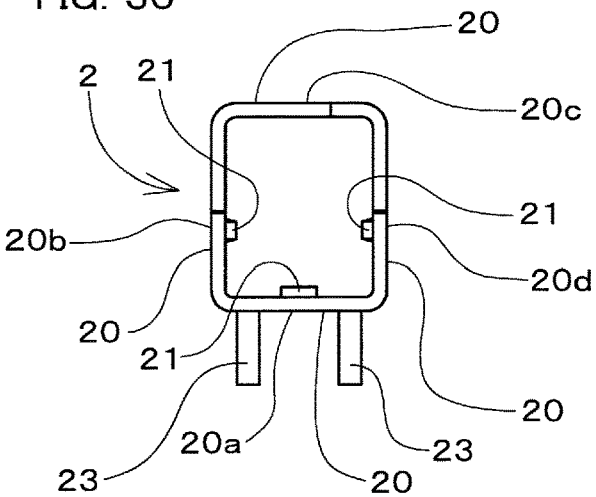
Figure 3D:
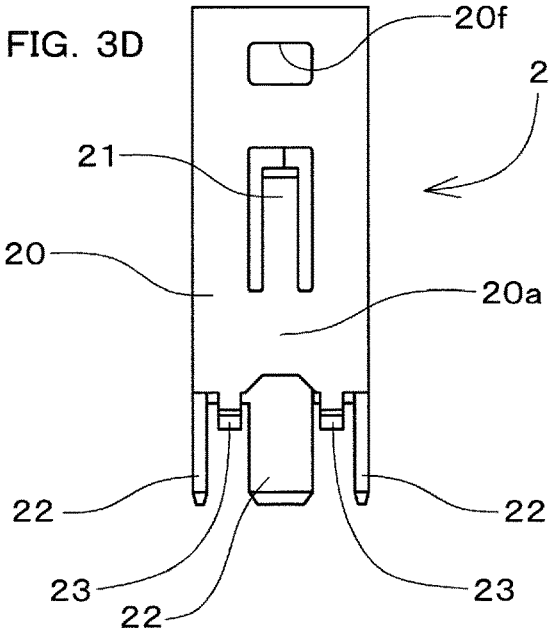

FIGS. 3A to 3D are diagrams showing the shield member 2 shown in FIG. 2, with FIG. 3A being a rear view, FIG. 3B being a left side surface, FIG. 3C being a plan view, and FIG. 3D being a front view.

The shield member 2 shown in FIGS. 2, 3A to 3D, and 4 to 7 has a tubular shape. The shield member 2 is formed by performing punch processing, fold processing, and the like on a flat plate-shaped metal member. The contact 4 is arranged inside the shield member 2. The shield member 2 can prevent electromagnetic waves from intruding from the outside to the inside of the shield member 2, and the contact 4 arranged inside the shield member 2 is not influenced by such electromagnetic waves. Also, the shield member 2 is configured such that the partner shield member 102 that blocks electromagnetic waves in the partner connector 100 can be inserted into the shield member 2. More specifically, the shield member 2 has a rectangular tubular shape that is constituted by four side walls 20.

The shield member 2 also has cantilevered elastic contacting portions 21 for coming into contact with the partner shield member 102. Furthermore, the lower side of the shield member 2 is provided with substrate fixing portions 22 for fixing the shield member 2 to the substrate, and substrate ground portions 23 for grounding the shield member 2 to the substrate.

The shield member 2 is provided with a first side wall 20*a*, a second side wall 20*b*, a third side wall 20*c*, and a fourth side wall 20*d* as the side walls 20. These four side walls 20 of the shield member 2, namely the first side wall 20*a*, the second side wall 20*b*, the third side wall 20*c*, and the fourth side wall 20*d*, are arranged in this order in the circumferential direction and are continuous and integrated with each other. The first side wall 20*a* is provided on the front side of the shield member 2. The second side wall 20*b* is provided on the left side of the shield member 2. The third side wall 20*c* is provided on the rear side of the shield member 2. The fourth side wall 20*d* is provided on the right side of the shield member 2.

Also, in a portion of the shield member 2 located on the upper side, a cutout portion 20*e*, which is formed by cutting out portions of the side walls 20, is formed in the rear side portion of the shield member 2. An engaging hole portion 20*f* for engagement with the engaging protrusion portion 102*a* of the partner shield member 102 is provided in the upper side portion of the first side wall 20*a* of the shield member 2. Three of the four side walls 20, namely the first side wall 20*a*, the second side wall 20*b*, and the fourth side wall 20*d* each have a contacting portion 21 for coming into contact with the partner shield member 102 that is for blocking electromagnetic waves in the partner connector 100. Note that in the present embodiment, the elastic contacting portions 21 constitute the contacting portions 21 as well, and hereinafter the elastic contacting portions 21 are also referred to as the contacting portions 21.

The cutout portion 20*e* is provided so as to circumvent a joining portion 32 that integrally joins an outer housing portion 30 and an inner housing portion 31 that will be described later. The cutout portion 20*e* is provided in a portion that is on the upper side and the rear side of the shield member 2. Specifically, the cutout portion 20*e* is formed by cutting out portions on the upper side of the second side wall 20*b*, the third side wall 20*c*, and the fourth side wall 20*d* of the shield member 2. Note that it is sufficient that the cutout portion 20*e* is provided on the upper side so as to enable joining of the outer housing portion 30 and the inner housing portion 31, and may also be provided on sides other than the rear side of the shield member 2.

The engaging hole portion 20*f* is provided in the upper side of the first side wall 20*a*, and is configured to be engaged with the engaging protrusion portion 102*a* provided on the partner shield member 102 when the connectors are connected.

The contacting portion 21 is provided in three of the four side walls 20, namely the first side wall 20*a*, the second side wall 20*b*, and the fourth side wall 20*d*. For this reason, the shield member 2 supports the partner shield member 102 using the contacting portions 21 in these three side walls (20*a*, 20*b*, and 20*d*). Accordingly, the partner shield member 102 is supported by the shield member from three directions, namely from the front side, the right side, and the left side, and is stably grounded.

The elastic contacting portions 21, which also constitute the contacting portions 21 in the present embodiment, are formed by forming cantilevered portions by cutting the side walls 20 and bending the cantilevered portions inward.

The substrate fixing portions 22 are provided on the lower sides of the second side wall 20*b*, the third side wall 20*c*, and the fourth side wall 20*d*, and extend downward from these side walls 20*b*, 20*c*, and 20*d*. The substrate fixing portions 22 are electrically and mechanically connected to the substrate by soldering. The electrical connector 1 is fixed to the substrate due to the substrate fixing portions 22 being connected to the substrate.

The substrate ground portions 23 are provided on the lower side of the first side wall 20*a*, and are configured to extend forward from the first side wall 20*a* and extend substantially parallel with the substrate. The substrate ground portions 23 are configured to be electrically connected to the substrate by soldering.

Housing

Figure 4:
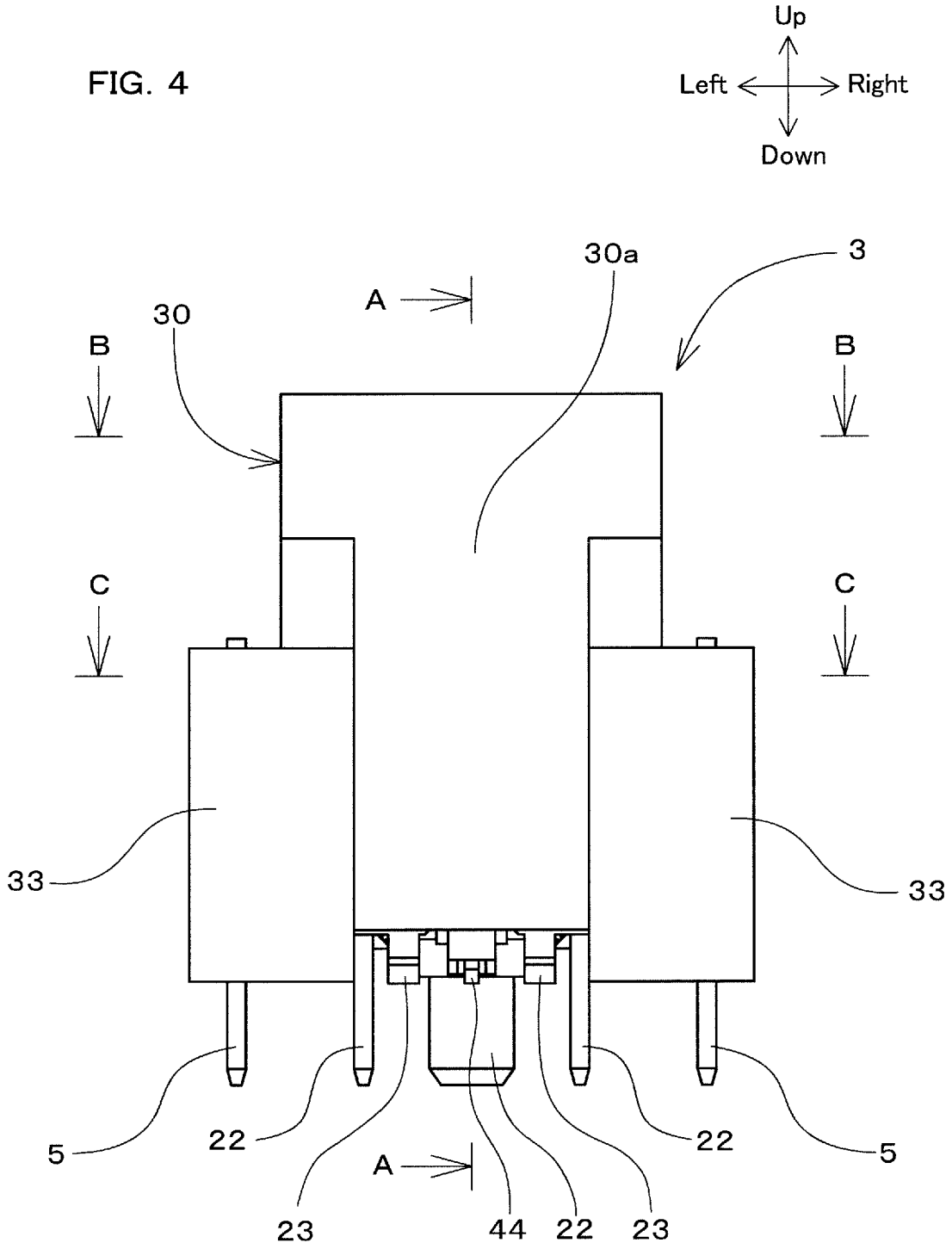
FIG. 4 is a front view of the electrical connector shown in FIG. 1.
Figure 5:
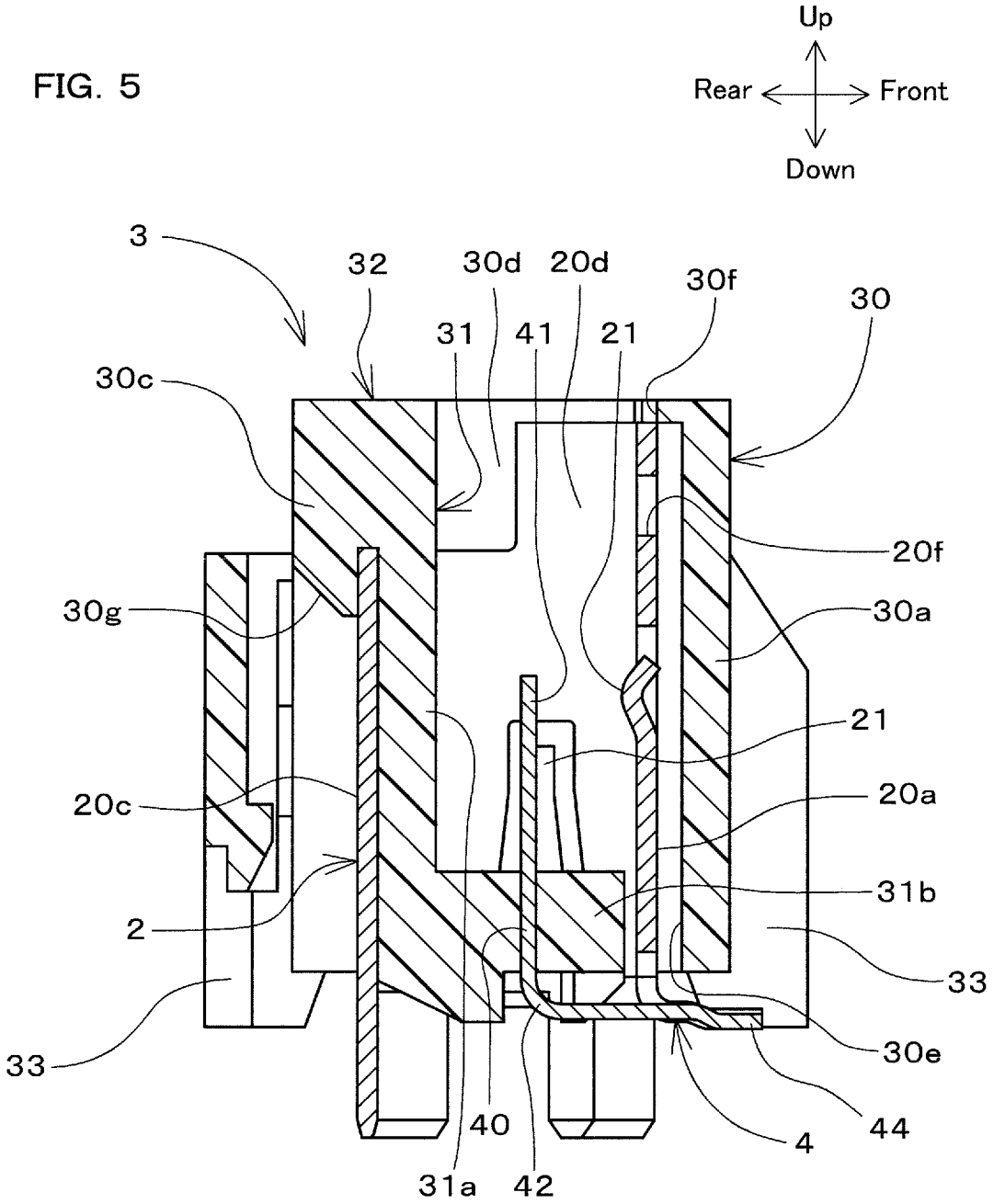
FIG. 5 is a cross-sectional diagram showing a cross-section of the electrical connector shown in FIG. 4 taken along a line A-A and viewed in a direction along the arrows.
Figure 6:
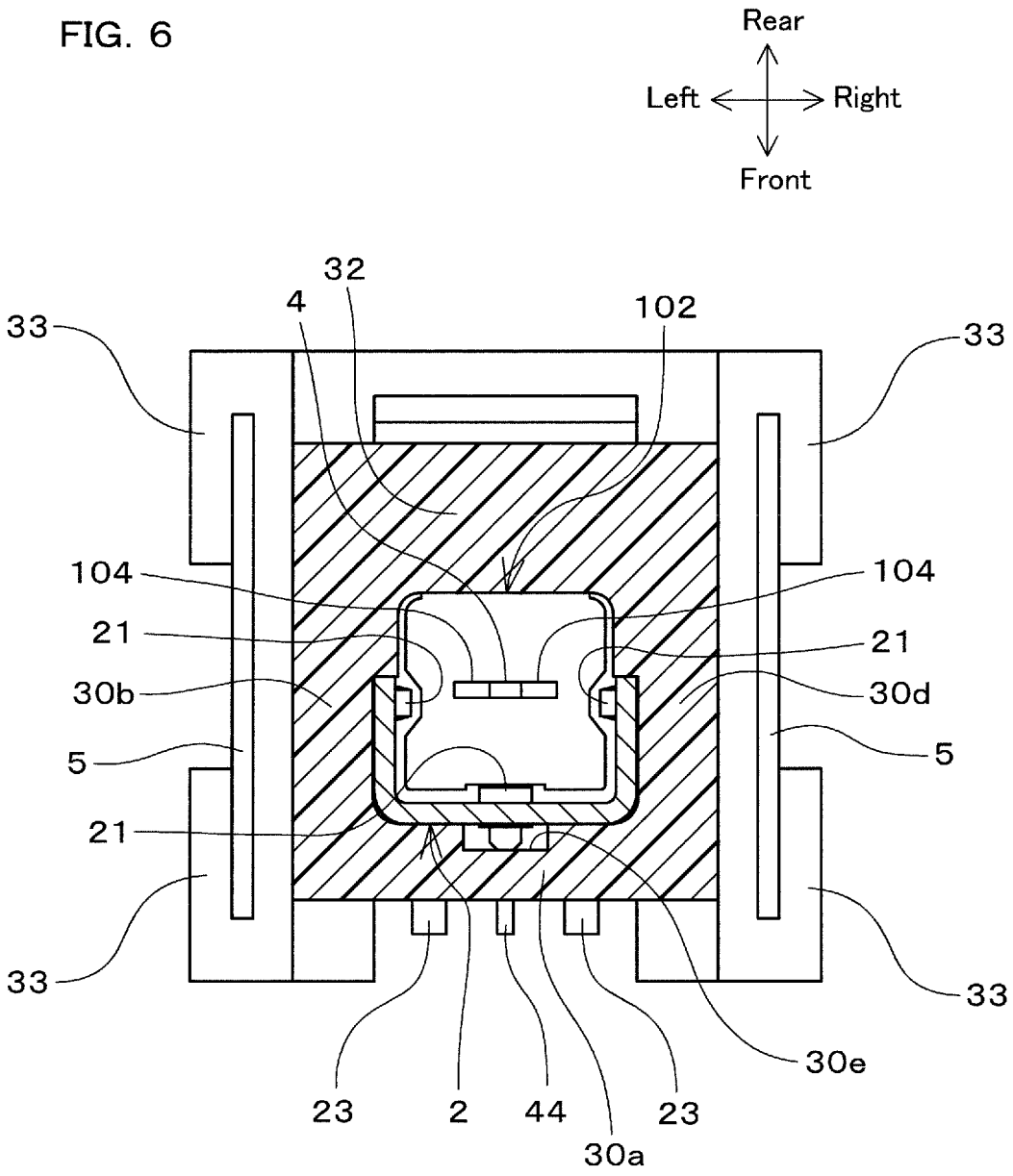
FIG. 6 is a cross-sectional diagram showing a cross-section of the electrical connector shown in FIG. 4 taken along a line B-B and viewed in a direction along the arrows.
Figure 7:
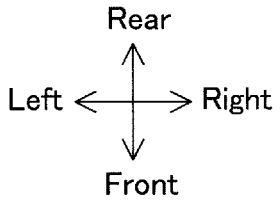
FIG. 7 is a cross-sectional diagram showing a cross-section of the electrical connector shown in FIG. 4 taken along a line C-C and viewed in a direction along the arrows.
Figure 7:
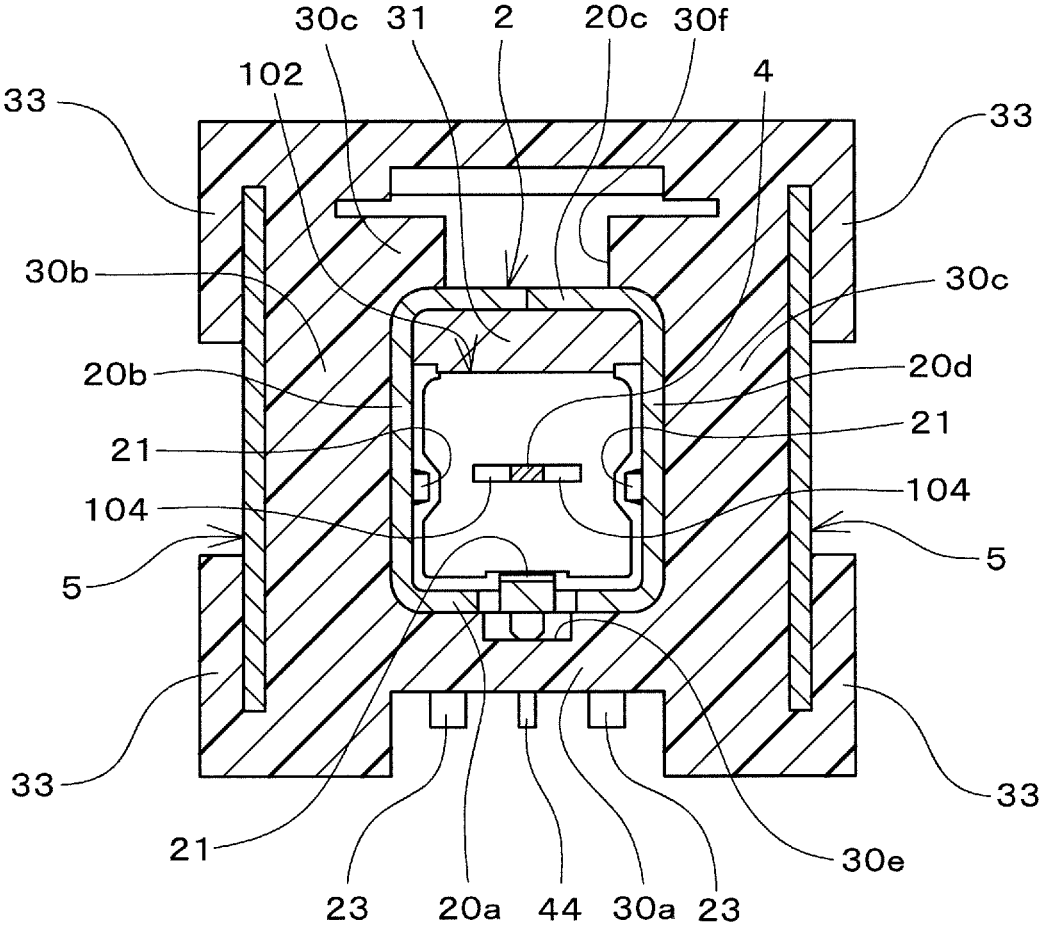

FIG. 4 is a front view of the electrical connector shown in FIG. 1. FIG. 5 is a cross-sectional diagram showing a cross-section of the electrical connector shown in FIG. 4 taken along a line A-A and viewed in a direction along the arrows. FIG. 6 is a cross-sectional diagram showing a cross-section of the electrical connector shown in FIG. 4 taken along a line B-B and viewed in a direction along the arrows. FIG. 7 is a cross-sectional diagram showing a cross-section of the electrical connector shown in FIG. 4 taken along a line C-C and viewed in a direction along the arrows.

The housing 3 shown in FIGS. 1, 2, and 4 to 7 is made of an insulating resin material, and is configured to include a substantially tube-shaped portion that has a predetermined thickness. The housing 3 has an outer housing portion 30 that is arranged outside of the shield member 2. The housing 3 also has an inner housing portion 31 that is arranged inside of the shield member 2. The housing 3 further has a joining portion 32 that integrally joins the outer housing portion 30 and the inner housing portion 31 in an end portion on one side in the direction parallel to the direction of mating with the partner connector 100.

The outer housing portion 30 and the inner housing portion 31 of the present embodiment are joined via the joining portion 32, and therefore the housing 3 is formed by one component. Accordingly, the number of components can be reduced in the electrical connector 1. Also, the housing 3 has tab housing portions 33 for housing the approximately flat plate-shaped tabs 5 on the right side and the left side. The housing 3 is fixed to the substrate via the tabs 5 that are housed in the tab housing portions 33.

The outer housing portion 30 shown in FIGS. 2 and 4 to 7 is approximately shaped as a tube that extends in the up-down direction. More specifically, the outer housing portion 30 is configured with an approximately rectangular tube shape including a first outer housing portion 30*a*, a second outer housing portion 30*b*, a third outer housing portion 30*c*, and a fourth outer housing portion 30*d*, which are arranged in this order in the circumferential direction and are continuous and integrated with each other.

The first outer housing portion 30*a* is provided in the front side portion of the outer housing portion 30. The second outer housing portion 30*b* is provided in the left side portion of the outer housing portion 30. The third outer housing portion 30*c* is provided in the rear side portion of the outer housing portion 30. The fourth outer housing portion 30*d* is provided in the right side portion of the outer housing portion 30.

The first outer housing portion 30*a*, the second outer housing portion 30*b*, and the fourth outer housing portion 30*d* shown in FIGS. 5 to 7 are formed as substantially plate-shaped portions that extend in the up-down direction and have a predetermined thickness. A recession portion 30*e* that extends in the up-down direction is formed in the inward surface of the first outer housing portion 30*a*, at a location in the central portion in the left-right direction. Also, a notch portion 30*f* is formed in the inward surface of the first outer housing portion 30*a*, at a location on the side corresponding to the end portion that is connected to the partner connector 100 by mating. The third outer housing portion 30*c* is formed as an approximately plate-shaped portion having a predetermined thickness, and is provided with an opening portion 30*g* that is open downward in the central portion in the left-right direction. The third outer housing portion 30*c* is integrally joined to the inner housing portion 31 via the joining portion 32.

The recession portion 30*e* is provided in order to prevent the metallic engaging projection 102*a* of the partner shield member 102 from coming to contact with and damaging the inward surface of the housing 3 when the partner connector 100 is inserted into the electrical connector 1. The notch portion 30*f* is provided in order to prevent the engaging projection 102*a* of the partner shield member 102 from coming to contact with and damaging the inward surface of the housing 3 when the partner connector 100 is inserted into the electrical connector 1.

The inner housing portion 31 shown in FIGS. 5 to 7 has a plate-shaped main body portion 31*a* that is substantially plate-shaped, extends in the up-down direction, and has a predetermined thickness, and a contact holding portion 31*b* that holds the contact 4.

The plate-shaped main body portion 31*a* is adjacent to the third side wall 20*c* of the shield member 2 on the front side of the third side wall 20*c*. Also, the plate-shaped main body portion 31*a* is adjacent to the rear side of the partner shield member 102 when the connectors are connected. Specifically, the plate-shaped main body portion 31*a* is sandwiched between the shield member 2 and the partner shield member 102 when the connectors are connected.

The plate-shaped main body portion 31*a* of the present embodiment is provided on only the rear side of the housing 3, and not on the front, left, and right sides thereof. For this reason, when the partner shield member 102 is inserted into the housing 3, only the rear side of the partner shield member 102 comes into contact with the inner housing portion 31. Note that besides the rear side, the inner housing portion 31 may be provided at one or more of the front side, the left side, and the right side. Also, a key groove for guiding mating with the partner shield member 102 may be provided in the plate-shaped main body portion 31*a*.

The contact holding portion 31*b* is provided in a manner of projecting inward at the lower side of the plate-shaped main body portion 31*a*. The contact holding portion 31*b* holds the contact 4 such that the axis of the contact 4 and the axis of the shield member 2 extend along the same line inside the shield member 2. Note that it is sufficient that the contact holding portion 31*b* can hold the contact 4 so as to enable mating with the partner contact, and the contact holding portion 31*b* may be arranged at a location other than the lower side, such as the upper side or the central portion of the plate-shaped main body portion 31*a*.

The joining portion 32 shown in FIGS. 1, 2, and 4 to 6 is provided on the upper side of the housing 3, which is the side corresponding to the end portion that is connected to the partner connector 100 by mating. The joining portion 32 of the present embodiment is arranged in a portion of the housing 3 that is on the upper side and the rear side. The joining portion 32 integrally joins the third outer housing portion 30*c* and the inner housing portion 31. Also, the joining portion 32 is provided on the upper side of the third side wall 20*c* of the shield member 2. Note that besides the rear side of the housing 3, the joining portion 32 may be provided at one or more of the front side, the left side, and the right side.

In the housing 3 of the present embodiment, the joining portion 32 is provided on the upper side, and therefore the shield member 2 is inserted from below when assembling the electrical connector 1. Also, the housing 3 is provided such that the end portion connected to the partner connector 100 by mating covers at least part of the end portion of the shield member 2. More specifically, the housing 3 is formed such that the portion thereof that is on the side that is connected to the partner connector 100 by mating and that is inward of the outer circumferential edge portion covers the upper end of the shield member 2.

According to the above configuration, the upper end of the first side wall 20*a* of the shield member 2 is covered by the first outer housing portion 30*a*. Similarly, the upper end of the second side wall 20*b* of the shield member 2 is covered by the second outer housing portion 30*b*, and the fourth side wall 20*d* is covered by the fourth outer housing portion 30*d*. Also, the upper end of the third side wall 20*c* of the shield member 2 is covered by the joining portion 32 of the housing 3.

The inward surface of the first side wall 20*a* of the shield member 2 is coplanar with a portion of the first outer housing portion 30*a* that faces inward and is located above the first side wall 20*a*. For this reason, when the partner shield member 102 is inserted, the partner shield member 102 abuts against the elastic contacting portions 21 of the shield member 2 and causes the elastic contacting portions 21 to undergo outward elastic deformation. The elastically deformed elastic contacting portions 21 support the partner connector 100 by pressing the wall surface portions 102*b* of the partner shield member 102 when the connectors are connected. Also, due to the partner shield member 102 being covered by the protection portion 102*c*, the housing 3 is not likely to become damaged.

Contact

The contact 4 shown in FIGS. 2 and 5 is constituted by a flat plate-shaped conductive member that is made of a metal, and has a contact main body portion 40, a contact portion 41, a curved portion 42, an extending portion 43, and a substrate connection portion 44.

The contact main body portion 40 of the present embodiment is shaped as a tapered flat plate, and is press-fitted into the contact holding portion 31*b* of the inner housing portion 31. The contact portion 41 is provided on the upper side of the contact main body portion 40, and is arranged such that the central axis is coaxial with the central axis of the shield member 2.

The curved portion 42 curves forward to the front side of the housing 3 at the lower end of the contact main body portion 40. Specifically, the curved portion 42 curves from the lower end of the contact main body portion 40 toward the side of the housing 3 that is opposite to the side on which the joining portion 32 is provided. The extending portion 43 extends forward from the curved portion 42 along a path below the first side wall 20*a*. The substrate connection portion 44 extends forward from the extending portion 43 and is substantially parallel with the substrate. The substrate connection portion 44 is provided as a portion for being electrically and mechanically connected to the substrate by soldering. Note that the contact 4 of the present embodiment is configured by a flat plate-shaped pin, but may have another shape, such as having a tubular shape.

Actions and Effects of Present Embodiment

According to the present embodiment, the housing 3 that holds the shield member 2 has the joining portion 32 that integrally joins the outer housing portion 30 and the inner housing portion 31 in an end portion on one side in the direction parallel to the direction of mating with the partner connector 100. In other words, the housing 3 is constituted by one component in which the outer housing portion 30 and the inner housing portion 31 are integrated via the joining portion 32. Accordingly, it is possible to reduce the number of components that constitute the electrical connector 1.

Also, the joining portion 32 is provided in the end portion on one side of the housing 3. For this reason, the shield member 2 held in the housing 3 is not provided with a slit-shaped gap, and has a tubular shape. This therefore improves the bending resistance and twisting resistance of the shield member 2, and improves the rigidity of the electrical connector 1.

Furthermore, due to the shield member 2 having a tubular shape, and the contact 4 being arranged therein, a gap that allows the intrusion of electromagnetic waves is not formed in the region surrounding the contact 4, and the contact 4 is reliably shielded by the shield member 2. Accordingly, a decrease in the shielding performance of the electrical connector 1 can be suppressed.

Accordingly, according to the present embodiment, it is possible to provide the electrical connector 1 that enables reducing the number of components, improving rigidity, and suppressing a decrease in shielding performance.

Also, due to reliably blocking the intrusion of electromagnetic waves toward the contact 4, the electrical connector 1 reliably exhibits shielding performance, and therefore is suitable for high frequency data transmission. This therefore enables realizing the electrical connector 1 that can also be applied to electronic devices that handle a large amount of information.

Also, according to the present embodiment, the joining portion 32 is provided in the end portion of the housing 3 on the side that is connected to the partner connector 100 by mating. For this reason, the direction in which the shield member 2 is attached to the housing 3 during assembly of the electrical connector 1 and the direction in which the partner shield member 102 is connected to the housing 3 by mating can be set to opposite directions. Accordingly, it is possible to avoid the case where the end portion of the shield member 2 and the end portion for connection to the partner connector 100 by mating are both arranged in the end portion on one side in the direction parallel to the mating direction. Accordingly, it is possible to prevent the structure of the electrical connector 1 from becoming complex. Also, the end portion of the joining portion 32 on the side that is connected to the partner connector 100 by mating has a simple structure, thus making it possible to obtain the electrical connector 1 that can be connected easily.

Also, according to the present embodiment, the housing 3 is provided so as to cover part or all of the end portion of the shield member 2 on the side that is mated with the partner connector 100. Moreover, the housing 3 is formed from an insulating resin material. For this reason, even if the end portion of the partner connector 100 collides with the end portion of the electrical connector having the above configuration, it is possible to mitigate the impact, and it is possible to realize the electrical connector 1 that is not likely to become damaged at the end portion. Also, the electrical connector having the above configuration may be realized as an electrical connector having a housing in which a portion that is in the end portion on the side that is connected to the partner connector by mating and that is inward of the outer circumferential edge portion covers at least part of the end portion of the shield member, for example.

Also, according to the present embodiment, the shield member 2 has a rectangular tubular shape that is constituted by the four side walls 20. Among the four side walls 20 of the shield member 2, three side walls (first side wall 20*a*, second side wall 20*b*, and fourth side wall 20*d*) each have a contacting portion 21 for coming into contact with the partner shield member 102 that blocks electromagnetic waves in the partner connector 100. For this reason, the shield member 2 can support the partner shield member 102 from three directions when the connectors are connected.

The shield member 2 can therefore be grounded with the partner shield member 102 in a stable state. The shield member 2 is also in contact with the partner shield member 102 at a larger number of locations, thus making it possible to realize more reliable grounding.

Also, in the present embodiment, the housing 3 of the electrical connector 1 is provided so as to cover the end portion of the shield member 2 on the side for mating with the partner connector 100, in order to prevent damage when a collision occurs between the electrical connector 1 and the partner connector 100. For this reason, it is desirable that the shield member 2 is provided with a mechanism for connection to the inserted partner shield member 102. In regards to this, the shield member 2 of the electrical connector 1 of the present embodiment has the elastic contacting portions 21 that undergo outward elastic deformation when the partner shield member 102 is inserted. The elastically deformed elastic contacting portions 21 support the partner connector 100 by pressing the wall surface portions 102*b* of the partner shield member 102 when the connectors are connected. Accordingly, even in the present embodiment configured such that the housing 3 covers the end portion of the shield member 2 so as to prevent damage when a collision occurs between the connectors, the shield member 2 and the partner shield member 102 can be connected by the elastic contacting portions 21 when the connectors are connected. Moreover, when the connectors are connected, the contact 4 is surrounded by two components, namely the shield member 2 and the partner shield member 102 that has been inserted into the shield member 2 and is connected by the shield member 2. This therefore further improves the shielding performance.

Although an embodiment of the present invention has been described thus far, the present invention is not limited to the above-described embodiment, and various modifications can be made within the scope recited in the claims. In other words, the present invention is not limited to the above embodiment, and all modifications, applications, and equivalents thereof that fall within the claims, for which modifications and applications would become naturally apparent by reading and understanding the present specification, are intended to be embraced in the claims of the invention. For example, variations such as the following can be carried out.

Variations

Although the above embodiment describes an example of an electrical connector that includes one contact, the present invention may be applied to an electrical connector configured as a multipolar connector that includes multiple contacts. Note that the following describes a variation with reference to the drawings, and elements having configurations similar to those of the above embodiment, as well as elements having configurations that correspond to those of the above embodiment, will be denoted by the same reference signs in the drawings or referred to by the same reference signs, thereby omitting descriptions for them.

Figure 8:
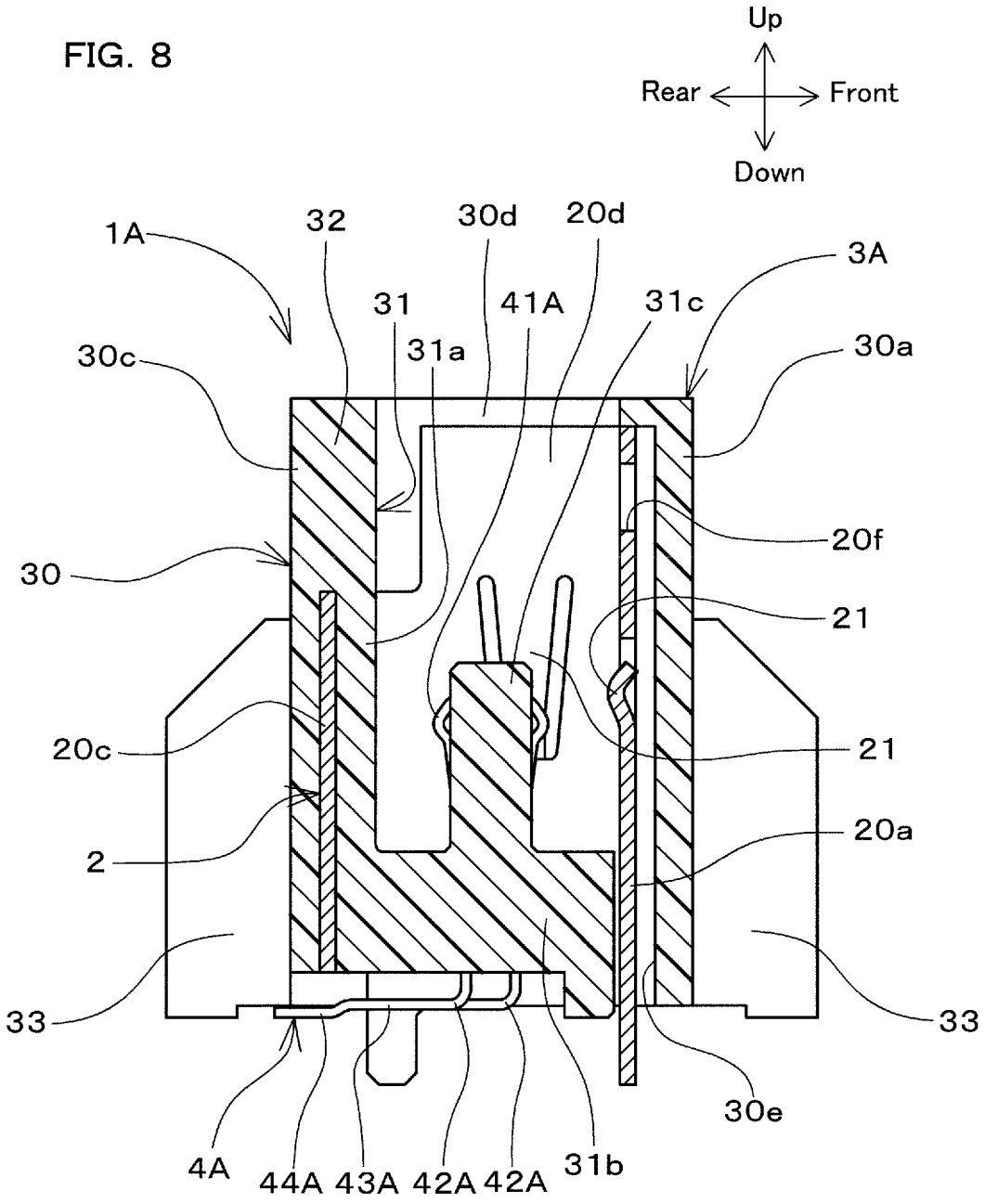
FIG. 8 is a cross-sectional diagram showing a cross-section taken along the height direction of an electrical connector according to a variation.
Figure 9:
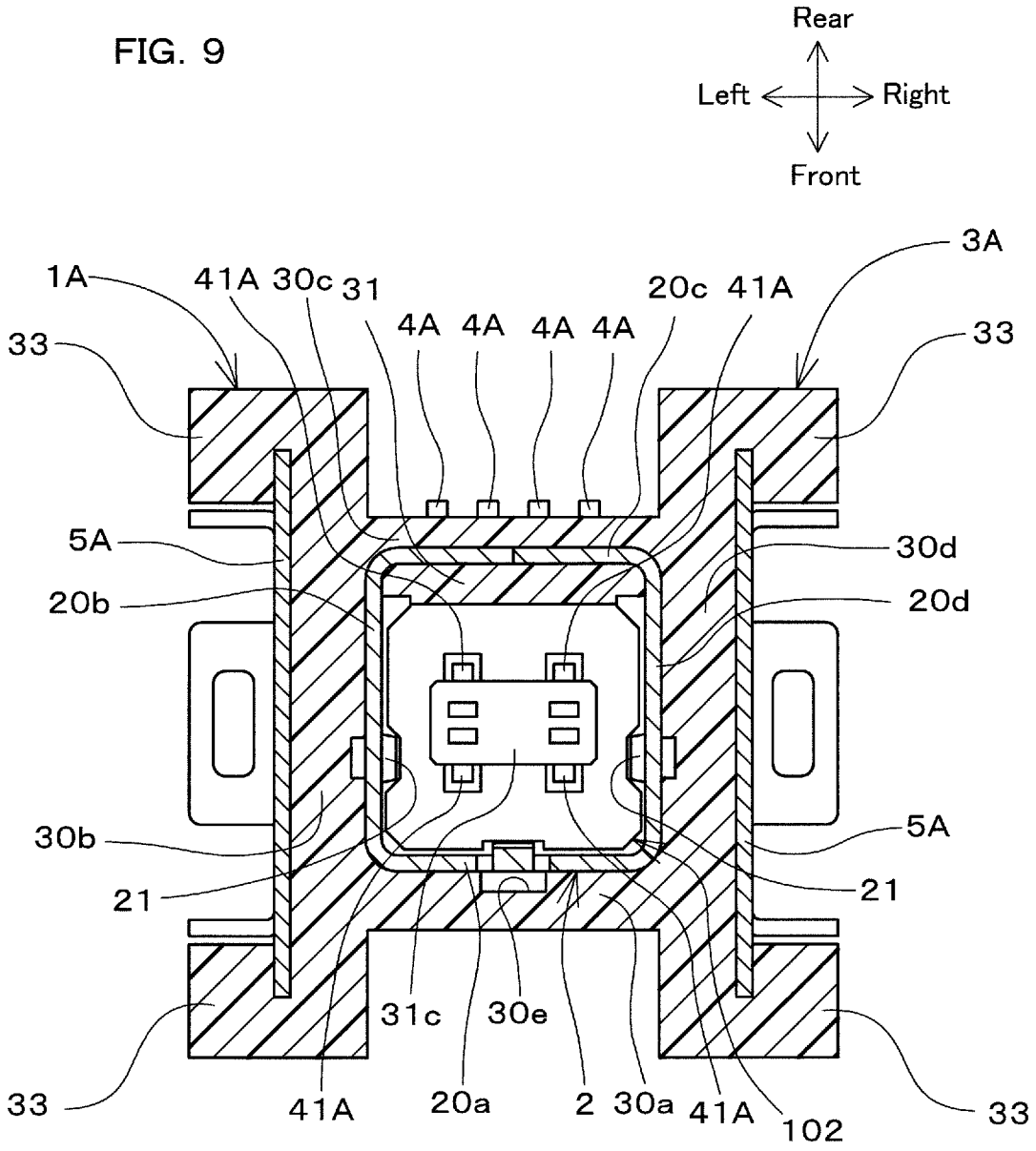
FIG. 9 is a cross-sectional diagram showing a cross-section taken perpendicular to the height direction of the electrical connector according to the variation.

FIG. 8 is a cross-sectional diagram showing a cross-section taken along the height direction of an electrical connector according to a variation. FIG. 9 is a cross-sectional diagram showing a cross-section taken perpendicular to the height direction of the electrical connector according to the variation.

As shown in FIGS. 8 and 9, an electrical connector 1A of the present variation includes the shield member 2, a housing 3A, and multiple contacts 4A. Also, as shown in FIG. 9, the electrical connector 1A is fixed to a substrate via tabs 5A that are arranged on the right side and the left side of the housing 3A.

The housing 3A is different from the housing 3 of the above embodiment in that the outer housing portion 30 is not provided with the opening portion 30*g* that is formed in the lower side of the third outer housing portion 30*c*. Furthermore, the housing 3A is different from the housing 3 of the above embodiment in that the inner housing portion 31 includes a contact housing portion 31*c* that projects upward from the contact holding portion 31*b* and holds the contacts.

The electrical connector 1A of the present variation is provided with four contacts 4A. The contacts 4A each have a contact main body portion (not shown), a contact portion 41A, a curved portion 42A, an extending portion 43A, and a substrate connection portion 44A.

The contact portion 41A of each of the contacts 4A extends in the up-down direction in the contact housing portion 31*c*. The contact portions 41A of two of the four contacts 4A are provided on the front side of the contact housing portion 31*c*. The contact portions 41A of the remaining two of the four contacts 4A are provided on the rear side of the contact housing portion 31*c*. The contact portions 41A are in contact with and electrically connected to partner contacts when the connectors are connected. Also, the leading end portions of the contact portions 41A are provided so as to be inclined outward from the contact housing portion 31*c* so as to come into contact with the partner contacts when the connectors are connected.

Each of the curved portions 42A curves toward the rear side of the housing 3A at the lower end of the contact main body portion. Specifically, the curved portion 42A curves from the lower end of the contact main body portion toward the side of the housing 3A on which the joining portion 32 is provided. The extending portion 43A extends rearward from the curved portion 42A along a path below the third side wall 20*c*. The substrate connection portion 44A is provided so as to extend rearward from the extending portion 43A and also extend substantially parallel with the substrate. The substrate connection portion 44A is provided as a portion that is electrically and mechanically connected to the substrate by soldering.

Effects similar to those of the above embodiment can be achieved in the present variation as well. Specifically, according to the present variation, in the electrical connector 1A that includes multiple contacts, it is possible to reduce the number of components, improve rigidity, and suppress a decrease in shielding performance.

INDUSTRIAL APPLICABILITY

The present invention is broadly applicable to an electrical connector that has a metallic shield member for blocking electromagnetic waves.

What is claimed is:

1. An electrical connector for connection to a partner connector by mating, the electrical connector comprising:

a contact;

a housing configured to hold the contact; and a shield member configured to be held in the housing and block electromagnetic waves, wherein the shield member has, in substantially its entirety, a tubular shape, and the contact is arranged inside the shield member, and the housing has an outer housing portion arranged outside of the shield member, an inner housing portion arranged inside the shield member, and a joining portion that integrally joins the outer housing portion and the inner housing portion in an end portion on one side in a direction parallel to a direction of mating with the partner connector, wherein the shield member has a rectangular tubular shape formed by four side walls, and wherein three of the four side walls each have a contacting portion configured to come into contact with a partner shield member that blocks electromagnetic waves in the partner connector.

2. The electrical connector according to claim 1, wherein the joining portion is provided in an end portion of the housing on a side that is to be connected to the partner connector by mating.

3. The electrical connector according to claim 2, wherein the housing is provided such that an end portion of the housing that is to be connected to the partner connector by mating covers at least part of an end portion of the shield member.

4. The electrical connector according to claim 3, wherein the shield member is configured to enable a partner shield member that blocks electromagnetic waves in the partner connector to be inserted into the shield member, and has a cantilevered elastic contacting portion configured to come into contact with the partner shield member.

* * * * *